US008099800B2

(12) United States Patent
Sawalski et al.

(10) Patent No.: US 8,099,800 B2
(45) Date of Patent: Jan. 24, 2012

(54) TOILET BOWL CLEANING AND/OR DEODORIZING DEVICE

(75) Inventors: Michael M. Sawalski, Racine, WI (US); Linda M. Madore, Vernon Hills, IL (US); Timothy R. Ordiway, Racine, WI (US); Thomas D. Gueldenzopf, Racine, WI (US); Jeffrey L. Crull, McFarland, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1299 days.

(21) Appl. No.: 11/800,493

(22) Filed: May 4, 2007

(65) Prior Publication Data

US 2007/0234470 A1 Oct. 11, 2007

Related U.S. Application Data

(63) Continuation-in-part of application No. 11/312,281, filed on Dec. 20, 2005, now Pat. No. 7,603,726.

(51) Int. Cl.
*E03D 9/02* (2006.01)

(52) U.S. Cl. ..... 4/223

(58) Field of Classification Search ..... 4/222–223, 4/231

See application file for complete search history.

(56) References Cited

U.S. PATENT DOCUMENTS

| | | | | |
|---|---|---|---|---|
| 1,366,426 | A | 1/1921 | Silvers | |
| 1,385,985 | A * | 8/1921 | Decker | 4/223 |
| 2,075,266 | A | 3/1937 | Bowman | |
| 2,166,772 | A | 7/1939 | Salsas-Serra | |
| 2,397,677 | A | 4/1946 | MacGlashan | |
| 2,614,265 | A | 10/1952 | Vierra | |
| 2,760,209 | A | 8/1956 | Ewing et al. | |
| 3,088,125 | A | 5/1963 | Southwood | |
| 3,128,018 | A | 4/1964 | Corsette et al. | |
| 3,178,070 | A * | 4/1965 | Leland | 222/180 |
| 3,532,273 | A | 10/1970 | Siddall et al. | |

(Continued)

FOREIGN PATENT DOCUMENTS

EP 0 274 785 A1 7/1988

(Continued)

OTHER PUBLICATIONS

International Search Report and Written Opinion dated Nov. 17, 2008, Appl. No. PCT/US2008/005716.

(Continued)

*Primary Examiner* — Lori Baker

(57) ABSTRACT

A device for spraying an inner surface of a toilet bowl with a cleaning and/or deodorizing chemical is disclosed. The device can include a container for the chemical, a sprayer through which the chemical can be sprayed laterally at least halfway around a perimeter of the sprayer, means for attaching the sprayer near a rim of the toilet bowl, a fluid conduit in fluid communication with the container and the sprayer, and a manually operated pump for delivering chemical from the container through the fluid conduit and to the sprayer when the pump is operated. In one version, the pump includes a pump chamber in fluid communication with the container, a discharge conduit in fluid communication with the pump chamber and in fluid communication with the fluid conduit, and a piston that reciprocates in the pump chamber for drawing fluid from the container into the pump chamber and moving fluid from the pump chamber through the discharge conduit and into the fluid conduit. The device can apply chemical around the entire circumference of the inner surface of the toilet bowl.

23 Claims, 10 Drawing Sheets

U.S. PATENT DOCUMENTS

| | | | | |
|---|---|---|---|---|
| 3,940,027 | A | | 2/1976 | Marterer |
| 3,946,448 | A | | 3/1976 | Sioufy |
| 3,953,902 | A | | 5/1976 | Taylor |
| 4,072,247 | A | | 2/1978 | Yamasaki |
| 4,077,750 | A | * | 3/1978 | Hake ..... 417/552 |
| 4,183,105 | A | | 1/1980 | Womack |
| 4,273,257 | A | | 6/1981 | Smith et al. |
| 4,407,217 | A | | 10/1983 | Jackson |
| RE32,017 | E | | 11/1985 | Hautmann et al. |
| 4,560,108 | A | | 12/1985 | Rubinstein |
| 4,562,867 | A | | 1/1986 | Stouffer |
| 4,618,077 | A | | 10/1986 | Corsette |
| 4,660,765 | A | | 4/1987 | Rosenberg |
| 4,670,916 | A | | 6/1987 | Bloom |
| 4,747,523 | A | | 5/1988 | Dobbs |
| 4,763,839 | A | | 8/1988 | Greenberg |
| 4,777,670 | A | | 10/1988 | Klinkhammer et al. |
| 4,817,869 | A | | 4/1989 | Rubinstein |
| 4,873,729 | A | | 10/1989 | Micallef |
| 5,022,098 | A | | 6/1991 | Brower |
| 5,123,124 | A | | 6/1992 | Brower |
| 5,143,293 | A | * | 9/1992 | Pairis ..... 239/222.17 |
| 5,203,506 | A | | 4/1993 | Gross et al. |
| 5,347,661 | A | | 9/1994 | Fly et al. |
| 5,457,822 | A | | 10/1995 | Klammsteiner |
| 5,806,104 | A | * | 9/1998 | Hand ..... 4/213 |
| 5,862,532 | A | | 1/1999 | Cain |
| 5,906,298 | A | | 5/1999 | Ward |
| 6,000,067 | A | | 12/1999 | Cascia |
| 6,015,067 | A | | 1/2000 | Lang et al. |
| 6,016,972 | A | | 1/2000 | Kantor et al. |
| 6,029,286 | A | * | 2/2000 | Funk ..... 4/223 |
| 6,162,371 | A | | 12/2000 | Rees et al. |
| 6,178,563 | B1 | | 1/2001 | Helfet |
| 6,178,564 | B1 | | 1/2001 | Leonard et al. |
| 6,230,334 | B1 | | 5/2001 | Camp et al. |
| 6,279,174 | B1 | | 8/2001 | Candusso |
| 6,347,414 | B2 | | 2/2002 | Contadini et al. |
| 6,394,310 | B1 | | 5/2002 | Muderlak et al. |
| 6,425,406 | B1 | | 7/2002 | Klinkhammer et al. |
| 6,471,974 | B1 | | 10/2002 | Rees et al. |
| 6,494,384 | B1 | | 12/2002 | Meyer |
| 6,505,356 | B1 | | 1/2003 | Leonard et al. |
| 6,588,026 | B2 | | 7/2003 | Meier et al. |
| 6,651,261 | B1 | | 11/2003 | Leonard et al. |
| 6,675,396 | B2 | | 1/2004 | Varanasi et al. |
| 6,694,536 | B1 | | 2/2004 | Haygreen |
| 6,702,157 | B1 | | 3/2004 | Dobbs |
| 6,739,479 | B2 | | 5/2004 | Contadini et al. |
| 6,769,580 | B2 | | 8/2004 | Muderlak et al. |
| 6,772,450 | B1 | | 8/2004 | Saylor et al. |
| 6,812,196 | B2 | | 11/2004 | Rees et al. |
| 6,820,821 | B2 | | 11/2004 | Linstedt et al. |
| 6,898,806 | B2 | | 5/2005 | Keramidas |
| 6,932,279 | B2 | | 8/2005 | Burcham |
| 6,944,890 | B1 | | 9/2005 | Sim |
| 6,971,549 | B2 | | 12/2005 | Leifheit et al. |
| 6,976,277 | B2 | | 12/2005 | Keramidas |
| 7,007,312 | B1 | | 3/2006 | Sim |
| 7,021,494 | B2 | | 4/2006 | Mazooji et al. |
| 7,114,199 | B2 | | 10/2006 | Conway et al. |
| 7,114,211 | B2 | * | 10/2006 | Elster ..... 15/24 |
| 7,127,750 | B2 | * | 10/2006 | Lim ..... 4/420.4 |
| 7,143,957 | B2 | | 12/2006 | Nelson |
| 7,543,339 | B1 | * | 6/2009 | Harris ..... 4/445 |
| 7,725,961 | B2 | * | 6/2010 | Martinez et al. ..... 4/321 |
| 7,837,132 | B2 | * | 11/2010 | Mazooji et al. ..... 239/263.1 |
| 7,895,683 | B2 | * | 3/2011 | Sawalski et al. ..... 4/223 |
| 2002/0130146 | A1 | | 9/2002 | Borut et al. |
| 2002/0148908 | A1 | | 10/2002 | Linstedt et al. |
| 2003/0056587 | A1 | | 3/2003 | Carpenter et al. |
| 2003/0188377 | A1 | | 10/2003 | Contadini et al. |
| 2004/0050959 | A1 | | 3/2004 | Mazooji et al. |
| 2005/0005378 | A1 | | 1/2005 | Soller et al. |
| 2005/0060797 | A1 | * | 3/2005 | Gilmore et al. ..... 4/450 |
| 2005/0120476 | A1 | * | 6/2005 | Reid ..... 4/661 |
| 2005/0133540 | A1 | | 6/2005 | Hornsby et al. |
| 2006/0006253 | A1 | | 1/2006 | Nelson |
| 2007/0000941 | A1 | * | 1/2007 | Hadden et al. ..... 222/52 |
| 2007/0040045 | A1 | | 2/2007 | Cohen |
| 2007/0045337 | A1 | | 3/2007 | Hornsby et al. |
| 2007/0067897 | A1 | * | 3/2007 | Graham, II ..... 4/228.1 |
| 2007/0158359 | A1 | | 7/2007 | Rodrian |
| 2007/0187427 | A1 | * | 8/2007 | Shaw et al. ..... 222/52 |
| 2007/0204387 | A1 | * | 9/2007 | Cornelius et al. ..... 4/223 |
| 2007/0204388 | A1 | * | 9/2007 | Zyskowski et al. ..... 4/228.1 |
| 2007/0204389 | A1 | * | 9/2007 | Graefe et al. ..... 4/231 |
| 2007/0240251 | A1 | * | 10/2007 | Pagani ..... 4/222 |
| 2007/0245470 | A1 | * | 10/2007 | Nguyen et al. ..... 4/223 |
| 2007/0289054 | A1 | | 12/2007 | Han et al. |
| 2008/0078780 | A1 | | 4/2008 | Sanger et al. |
| 2008/0155739 | A1 | * | 7/2008 | Uy ..... 4/443 |
| 2008/0216225 | A1 | * | 9/2008 | Juska et al. ..... 4/433 |
| 2008/0272200 | A1 | * | 11/2008 | Ordiway et al. ..... 239/7 |
| 2009/0000016 | A1 | * | 1/2009 | Sawalski et al. ..... 4/223 |
| 2009/0249533 | A1 | * | 10/2009 | Sawalski et al. ..... 4/223 |

FOREIGN PATENT DOCUMENTS

| | | | | |
|---|---|---|---|---|
| FR | 2588742 | | * | 4/1987 |
| FR | 2588742 | A | | 4/1987 |
| FR | 2874038 | | | 2/2006 |
| GB | 215407 | A | | 5/1924 |
| GB | 264364 | A | | 1/1927 |
| GB | 1140900 | A | | 2/1969 |
| GB | 2296670 | A | | 7/1996 |
| JP | 1-97423 | | | 4/1989 |
| JP | 1097423 | | * | 4/1989 |
| JP | 3-9714 | | | 1/1991 |
| JP | 3-228718 | | | 1/1991 |
| JP | 5-222757 | | | 8/1993 |
| JP | 6-170286 | | | 6/1994 |
| JP | 2000-166818 | A | | 2/2000 |
| JP | 2000-70797 | A | | 3/2000 |
| JP | 2002-04884 | | | 2/2002 |
| JP | 2002-180518 | | | 6/2002 |
| JP | 2002-286833 | | | 10/2002 |
| JP | 2004-100212 | | | 4/2004 |
| JP | 2004-283811 | | | 10/2004 |
| JP | 2005-36511 | | | 2/2005 |
| JP | 2005-46769 | | | 2/2005 |
| JP | 2005-52754 | | | 3/2005 |
| JP | 2005-103367 | | | 4/2005 |
| JP | 2005-211164 | | | 8/2005 |
| JP | 2005-344300 | | | 12/2005 |
| RO | 117293 | B | | 1/2002 |
| WO | WO 99/66139 | A1 | | 12/1999 |
| WO | WO 99/66140 | A1 | | 12/1999 |
| WO | 00/58573 | A | | 10/2000 |
| WO | 01/14652 | A | | 3/2001 |
| WO | WO 01/14652 | A1 | * | 3/2001 |
| WO | WO 01/44591 | A1 | | 6/2001 |
| WO | WO 2005/070474 | A1 | | 8/2005 |
| WO | WO 2006/013321 | A1 | | 2/2006 |
| WO | 2007/075819 | A | | 7/2007 |
| WO | 2008044201 | | | 4/2008 |
| WO | 2008076346 | | | 6/2008 |

OTHER PUBLICATIONS

English Language Abstract of JP 1-97423, Apr. 14, 1989.

English Language Machine Translation of JP 2002-180518, Dec. 11, 2000.

English Language Machine Translation of JP 2005-344300, May 31, 2004.

English Language Machine Translation of JP 2004-100212, Sep. 6, 2002.

English Language Machine Translation of JP 2002-286833, Jul. 15, 2003.

English Language Machine Translation of JP 2005-36511, Jul. 17, 2006.

English Language Machine Translation of JP 2005-211164, Jan. 27, 2004.

English Language Machine Translation of JP 2005-103367, Sep. 29, 2003.

English Language Machine Translation of JP 2005-52754, Aug. 5, 2003.

English Language Machine Translation of JP 2005-46769, Jul. 30, 2003.
English Language Machine Translation of JP 2004-283811, Mar. 19, 2003.
English Language Translation of JP 2000-70797, Aug. 31, 1998.
English Language Translation of JP 6-170286, Jun. 21, 1994.
English Language Machine Translation of JP 5-222757, Feb. 10, 1992.
English Language Machine Translation of JP 2002-048884, Jul. 31, 2000.
English Language Abstract of JP 3-9714, Jan. 17, 1991.
English Language Abstract of JP 3-228718, Oct. 9, 1991.
English Language Abstract of FR 2874038, Feb. 10, 2006.
U.S. Appl. No. 11/312,281, filed Dec. 20, 2005 by Sawalski et al.
Microsprinkler shown at www.dripirrigation.com, 3 pages, May 3, 2007.
English Language Abstract of FR 2588742, Apr. 24, 1987.
English Language Machine Translation of JP 2000-166818, Dec. 2, 1998.

* cited by examiner

FIG. 9
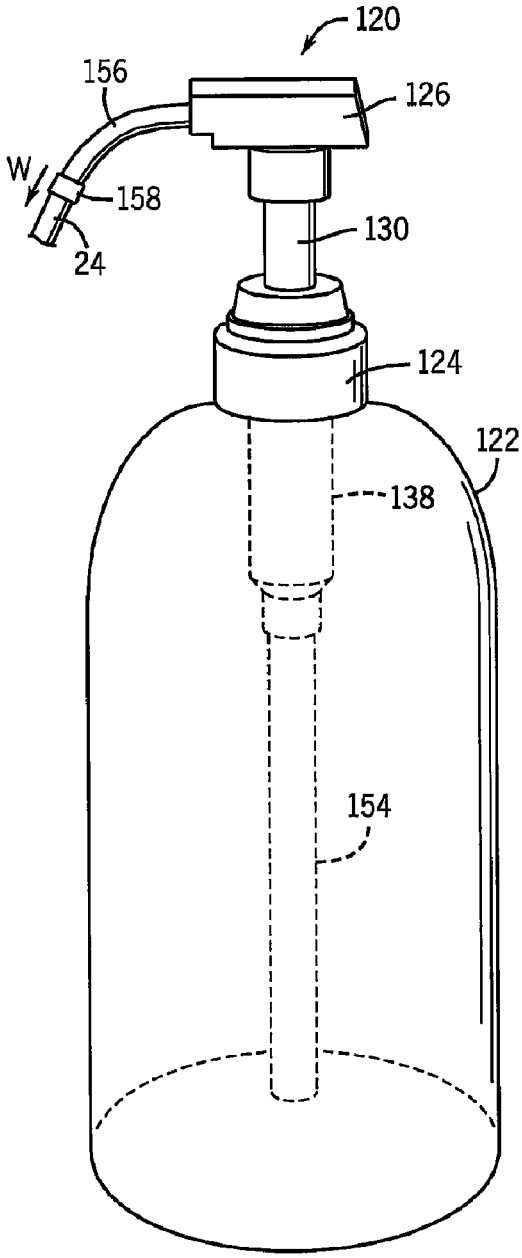
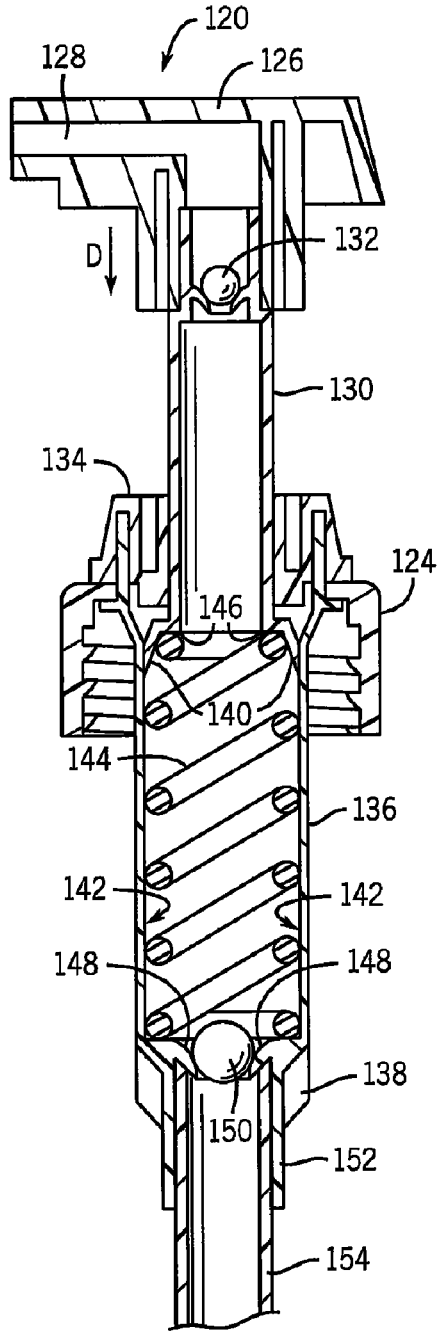
FIG. 10

TOILET BOWL CLEANING AND/OR DEODORIZING DEVICE

CROSS-REFERENCES TO RELATED APPLICATIONS

This application is a continuation-in-part of U.S. patent application Ser. No. 11/312,281 filed Dec. 20, 2005 now U.S. Pat. No. 7,603,726.

STATEMENT REGARDING FEDERALLY SPONSORED RESEARCH

Not Applicable.

BACKGROUND OF THE INVENTION

1. Field of the Invention

This invention relates to a toilet bowl cleaning device where the inner surface of the toilet bowl can be cleaned around the entire circumference of the toilet bowl at locations below the toilet waterline, and/or locations at the toilet waterline, and/or locations above the toilet waterline, and/or locations under the toilet rim.

2. Description of the Related Art

Toilet bowls require care to prevent the buildup of unsightly deposits, to reduce odors, and to prevent bacteria growth. Traditionally, toilet bowls have been cleaned, deodorized, and disinfected by manual scrubbing with a liquid or powdered cleaning and sanitizing agent. This task has required manual labor to keep the toilet bowl clean.

In order to eliminate the detested manual scrubbing, various toilet bowl cleaner dispensers have been proposed. One type of dispenser comprises a solid block or solid particles of a cleansing and freshening substance that is suspended from the rim of a toilet bowl in a container that is placed in the path of the flushing water. U.S. Pat. No. 4,777,670 (which is incorporated herein by reference along with all other documents cited herein) shows an example of this type of toilet bowl cleaning system. Typically, a portion of the solid block is dissolved in the flush water with each flush, and the flush water having dissolved product is dispensed into the toilet bowl for cleaning the bowl.

Other toilet bowl cleaning systems use a liquid cleaning agent that is dispensed into a toilet bowl. For example, U.S. Pat. Nos. 6,178,564 and 6,230,334, and PCT International Publication Nos. WO 99/66139 and WO 99/66140 all disclose cleansing and/or freshening devices capable of being suspended from the rim of a toilet bowl for introducing liquid active substances from a bottle into the flushing water with each flush. In these under the toilet rim devices, the liquid active substances are delivered downward from a reservoir to a dispensing plate that is supported by a base that is suspended from the toilet bowl rim. The device is suspended from the toilet rim such that the flow of flush water from the toilet contacts the dispensing plate during a flush. The flush water carries the liquid active substances that are on the dispensing plate into the toilet bowl to clean and freshen the toilet.

Other toilet bowl dispensers use an aerosol deodorizing and/or cleaning agent that is dispensed into a toilet bowl through a conduit attached to the toilet bowl rim. For example, U.S. Pat. No. 3,178,070 discloses an aerosol container mounted by a bracket on a toilet rim with a tube extending over the rim; and U.S. Pat. Nos. 6,029,286 and 5,862,532 disclose dispensers for a toilet bowl including a pressurized reservoir of fluid, a conduit connected to the source of fluid, and a spray nozzle which is installed on the toilet rim.

One disadvantage with these known toilet rim dispensing devices is that these devices may only apply the deodorizing and/or cleaning agent to one location in the toilet water or a limited area in the toilet water or on the inner surface of the toilet bowl. As a result, the cleaning of the inner surface of the toilet bowl may be limited to an area of the toilet bowl near the device. This is a drawback as it is desirable to obtain uniform application of cleaning fluid in the entire toilet bowl.

U.S. patent application Ser. No. 11/312,281, which is owned by the owner of the current invention, sets forth, among others, an automatic or manual toilet bowl cleaning device where the inner surface of the toilet bowl is cleaned around the entire circumference of the toilet bowl. In one embodiment illustrated in that application, the downstream end of a fluid conduit terminates in a rotating nozzle capable of spraying the fluid outwardly onto the inner surface of the toilet bowl.

In view of the advance in the art provided by the device of U.S. patent application Ser. No. 11/312,281, even further improvements to this technology would be beneficial to consumers.

SUMMARY OF THE INVENTION

The foregoing needs can be met with a toilet bowl cleaning and/or deodorizing device according to the invention that delivers a chemical into the toilet bowl. The term "chemical" or "chemistry" means one chemical or a mixture of chemical ingredients. Various cleaning and/or deodorizing chemicals are suitable for use with a toilet bowl cleaning device according to the invention. The toilet bowl cleaning and/or deodorizing device includes appropriate chemistry and a dispensing system. As used herein, the term "cleaning" also includes sanitizing and/or disinfecting, and the term "deodorizing" also includes freshening.

Regarding the chemistry, a chemical is applied directly onto the inner surface of the toilet bowl and/or into the toilet water so as to clean and freshen the toilet bowl. If applied to the inner surface of the toilet bowl, the chemical will typically be a liquid (single or multiple chemistries). If added to the toilet water, the chemistry can also be a liquid (single or multiple chemistries) that is added to the water to act as a preventive, or to create an environment that will work to clean the toilet automatically.

With respect to the dispensing system, the system includes several subsystems which are the means for applying the appropriate chemistry to the inner surface of the toilet bowl to conduct the cleaning process. The dispensing system may include (but is not limited to): (i) a chemistry storage container; (ii) a chemical propulsion system; (iii) a chemical delivery system; and (iv) a toilet interface.

The chemistry storage container is used to hold and store the chemistry used to clean the toilet bowl. Non-limiting examples include a standard plastic bottle, such as that found on a trigger sprayer.

The chemical propulsion system provides a method of providing the appropriate energy to the chemistry to move it through the delivery system so that it can move from the storage container to the appropriate area within the toilet bowl. Examples of this subsystem include a pump or pumping mechanism to move a liquid such as a vein pump, bellows pump, impeller driven pump, piston pump, peristaltic pump or gear driven pump.

The chemical delivery system provides a method of moving chemistry from its storage container to the appropriate area within the toilet bowl. This delivery subsystem can include a hose and a sprayer (e.g., a nozzle).

The toilet interface provides a means and method of attachment to the toilet to keep the hose out of the way, keep it uncrimped, and secure the sprayer nozzle into place on the toilet rim or toilet lid.

These subsystems work together to deliver the appropriate chemistry (using predetermined amounts) to deliver the desired consumer benefit.

Therefore, in one aspect, the invention provides a device for spraying an inner surface of a wall of an enclosure with a fluid. The enclosure can be one of a tub or a shower or a toilet. The device can include a container for the fluid, a fluid sprayer through which the fluid can be sprayed laterally at least halfway around a perimeter of the fluid sprayer, means for attaching the fluid sprayer near the inner surface of the wall of the enclosure, a fluid conduit in fluid communication with the container and the fluid sprayer, and a manually operated pump for delivering fluid from the container through the fluid conduit and to the fluid sprayer when the pump is operated. By a "manually operated" pump, we mean a pump that is operated by a hand or a foot rather than by a pneumatic device (e.g., a can with propellant) or an electrical device (e.g., a battery powered or an AC powered device).

In one version of the invention, the pump includes a pump chamber in fluid communication with the container, a discharge conduit in fluid communication with the pump chamber and in fluid communication with the fluid conduit, and a piston that reciprocates in the pump chamber for drawing fluid from the container into the pump chamber and moving fluid from the pump chamber through the discharge conduit and into the fluid conduit. The pump may further include an actuator in contact with the piston for manually reciprocating the piston in the pump chamber. The actuator can be a pivoting trigger or a horizontal member approximately transverse to the piston.

The pump may further include means for adjusting an amount of the fluid moving from the pump chamber through the discharge conduit and into the fluid conduit on a stroke of the piston in the pump chamber. The pump may further include a check valve between the fluid conduit and the discharge conduit. In one form, the pump chamber is oriented collinear or parallel with a vertical axis of the container. In one example version, the device sprays the inner surface of a toilet bowl, and the pump delivers about 5 to about 10 milliliters of fluid to the fluid sprayer on a stroke of the piston in the pump chamber. In another example version, the device sprays the inner surface of a shower enclosure, and the pump delivers up to about 50 to about 60 milliliters of fluid to the fluid sprayer on a stroke of the piston in the pump chamber.

In one version of the invention, the fluid sprayer is structured such that the fluid can be sprayed laterally around the entire perimeter of the fluid sprayer. The fluid sprayer can be a rotating nozzle. In one form, the nozzle includes a deflection plate, a fluid inlet at an upper end of the nozzle, a passageway extending between the fluid inlet and the deflection plate, a channel in fluid communication with a lower end of the passageway, and a pair of fins flanking the channel and extending upwardly from the deflection plate. The fins are contacted by the fluid to rotate the nozzle and spray fluid laterally around the entire perimeter of the fluid sprayer.

In one version of the invention, the means for attaching the fluid sprayer near the inner surface of the wall of the enclosure includes a base, a hook configured to support the base adjacent the wall of the enclosure, and means for attaching the fluid sprayer to the base. The means for attaching the fluid sprayer to the base can be an arm extending from the base.

In another aspect, the invention provides a device for spraying an inner surface of a toilet bowl with a chemical. The device includes a container for the chemical, a sprayer through which the chemical can be sprayed laterally at least halfway around a perimeter of the sprayer, means for attaching the sprayer near a rim of the toilet bowl, a fluid conduit in fluid communication with the container and the sprayer, and a manually operated pump for delivering chemical from the container through the fluid conduit and to the sprayer when the pump is operated.

In one version of the invention, the pump includes a pump chamber in fluid communication with the container, a discharge conduit in fluid communication with the pump chamber and in fluid communication with the fluid conduit, and a piston that reciprocates in the pump chamber for drawing chemical from the container into the pump chamber and moving chemical from the pump chamber through the discharge conduit and into the fluid conduit. The pump may include a hand-operated or foot-operated actuator in contact with the piston for manually reciprocating the piston in the pump chamber. The pump may further include means for adjusting an amount of the chemical moving from the pump chamber through the discharge conduit and into the fluid conduit on a stroke of the piston in the pump chamber. The pump can be selected from vein pumps, bellows pumps, impeller driven pumps, piston pumps, peristaltic pumps and gear driven pumps.

In one version of the invention, the sprayer is structured such that the chemical can be sprayed laterally around the entire perimeter of the sprayer. In one form, the means for attaching the sprayer near the rim of the toilet bowl includes a base, a hook configured to support the base adjacent the rim of the toilet bowl, and means for attaching the sprayer to the base. The sprayer can include a nozzle having a fluid inlet and a deflection plate where the fluid inlet is in fluid communication with the fluid conduit and the deflection plate, and the deflection plate is rotated when contacted by chemical from the fluid inlet thereby spraying chemical laterally around the entire perimeter of the sprayer and onto the entire circumference of the inner surface of the toilet bowl.

It is therefore an advantage of the invention to provide a toilet bowl cleaning device where the inner surface of the toilet bowl is cleaned around the entire circumference of the toilet bowl. The device provides for overall toilet bowl cleanliness by enhanced shine and the retardation of biofilm, mold and/or mildew growth. The device can deliver liquids to remove or eliminate stains (hard water, limescale, metals, organic), mold, mildew, germs, odors, and bacteria. The device can spray the entire toilet bowl and is not limited to just one small area of the toilet bowl.

These and other features, aspects, and advantages of the present invention will become better understood upon consideration of the following detailed description, drawings, and appended claims.

BRIEF DESCRIPTION OF THE DRAWINGS

FIG. 9 is a perspective view of a fluid dispensing pump that may be used to pump fluid from a container to the sprayer of the invention.

FIG. 10 is a vertical cross-sectional view of the fluid dispensing pump of FIG. 9.

Like reference numerals will be used to refer to like parts from Figure to Figure in the following description of the drawings.

DETAILED DESCRIPTION OF THE INVENTION

The invention provides a device for spraying an inner surface of a toilet bowl with a chemical. Various embodiments of the invention will now be described with reference to the Figures. The embodiments are shown and described for the purposes of illustration and are not intended to limit the invention in any way.

Figure 2:
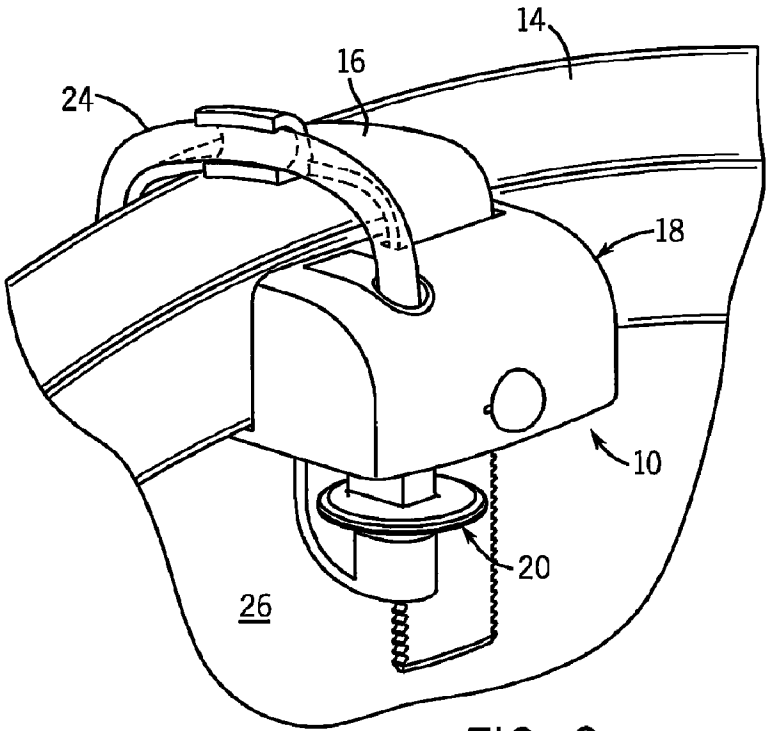
FIG. 2 is a perspective, fragmentary view taken along line 2-2 of FIG. 1 showing the clip and spray nozzle of the toilet bowl cleaning device of FIG. 1.
Figure 1:
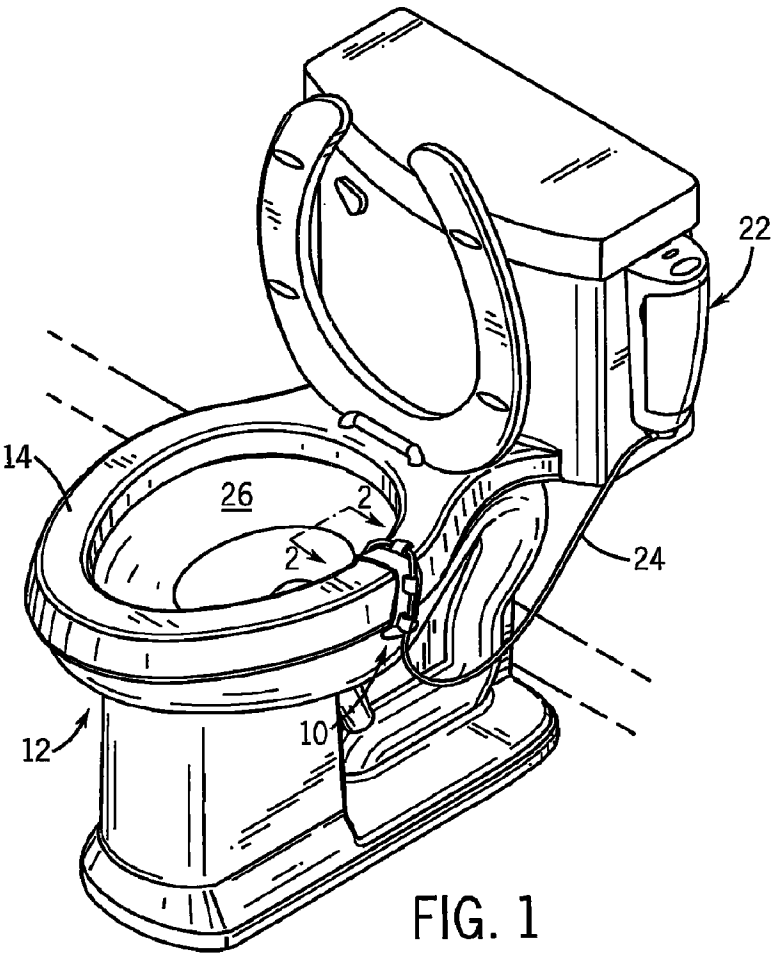
FIG. 1 is a perspective view of a toilet bowl cleaning device in accordance with an embodiment of the invention mounted to a toilet.

Turning to FIGS. 1 and 2, there is shown an example embodiment of a device for spraying an inner surface of a toilet bowl with a chemical. The device includes a clip 10 for mounting to an enclosure, here a toilet bowl 12. The clip 10 is secured to the rim 14 of the toilet bowl 12 by a hook 16. A base 18 is supported by the hook 16 and houses a fluid sprayer, here a spray nozzle 20. A container 22 supplies fluid via a fluid conduit 24 to the nozzle 20 to be dispensed onto the inside surface 26 of the toilet bowl 12. The fluid can be supplied from the container 22 to the fluid sprayer by different types of manual pumps which are described below in further detail.

Figure 3:
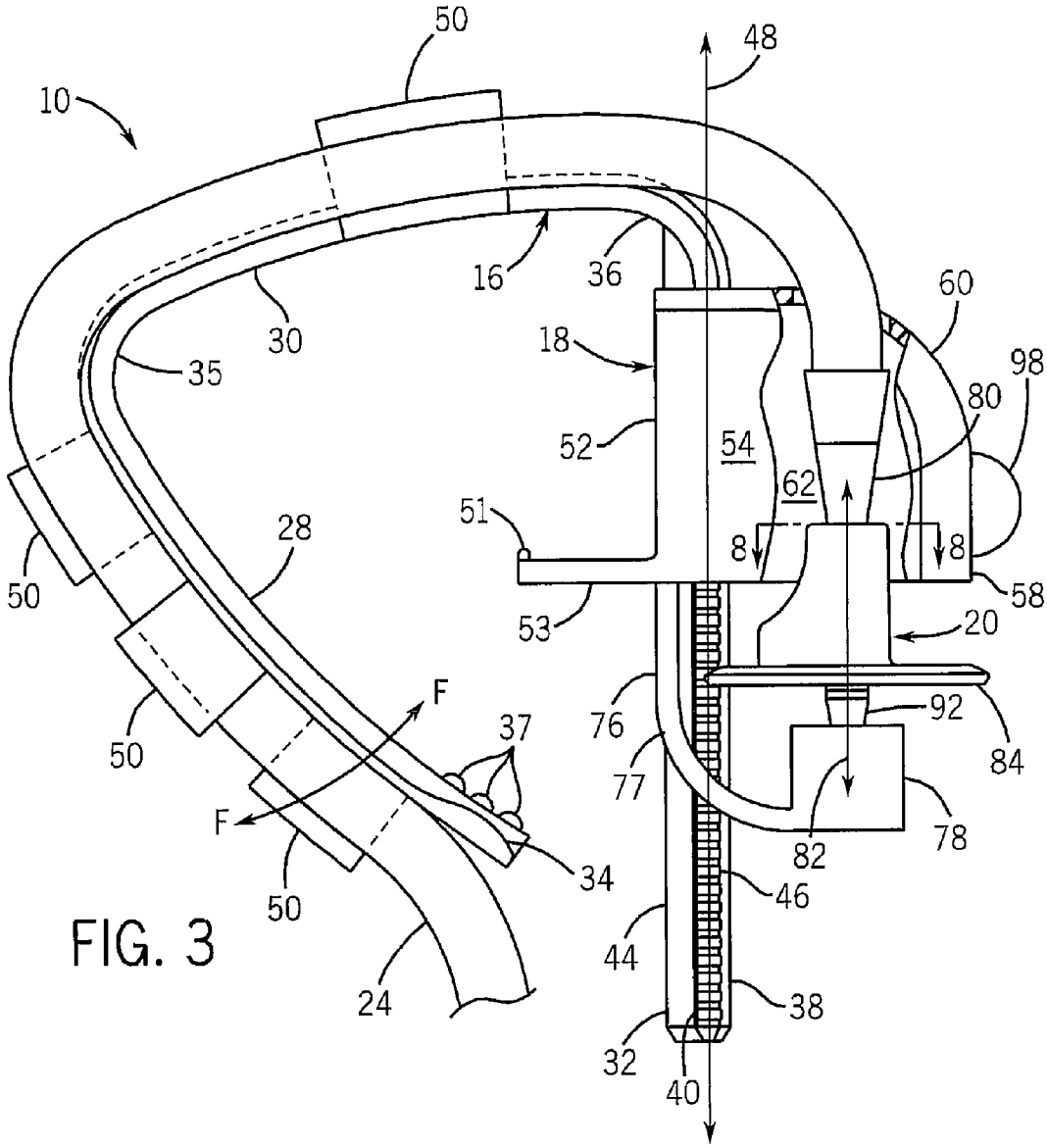
FIG. 3 is a side elevation view having a cutout showing a portion of the interior of the clip of FIG. 2.
Figure 4:
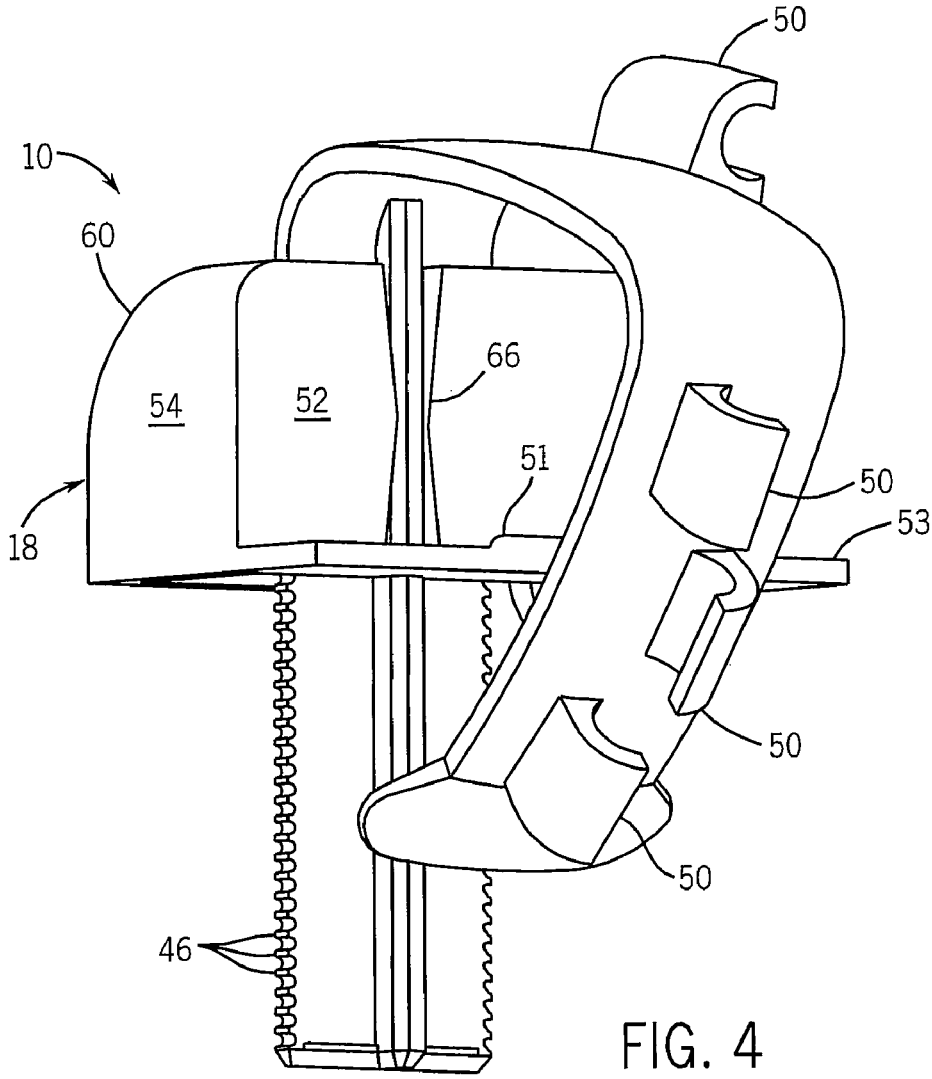
FIG. 4 is a rear oblique view of the clip of FIG. 2.
Figure 5:
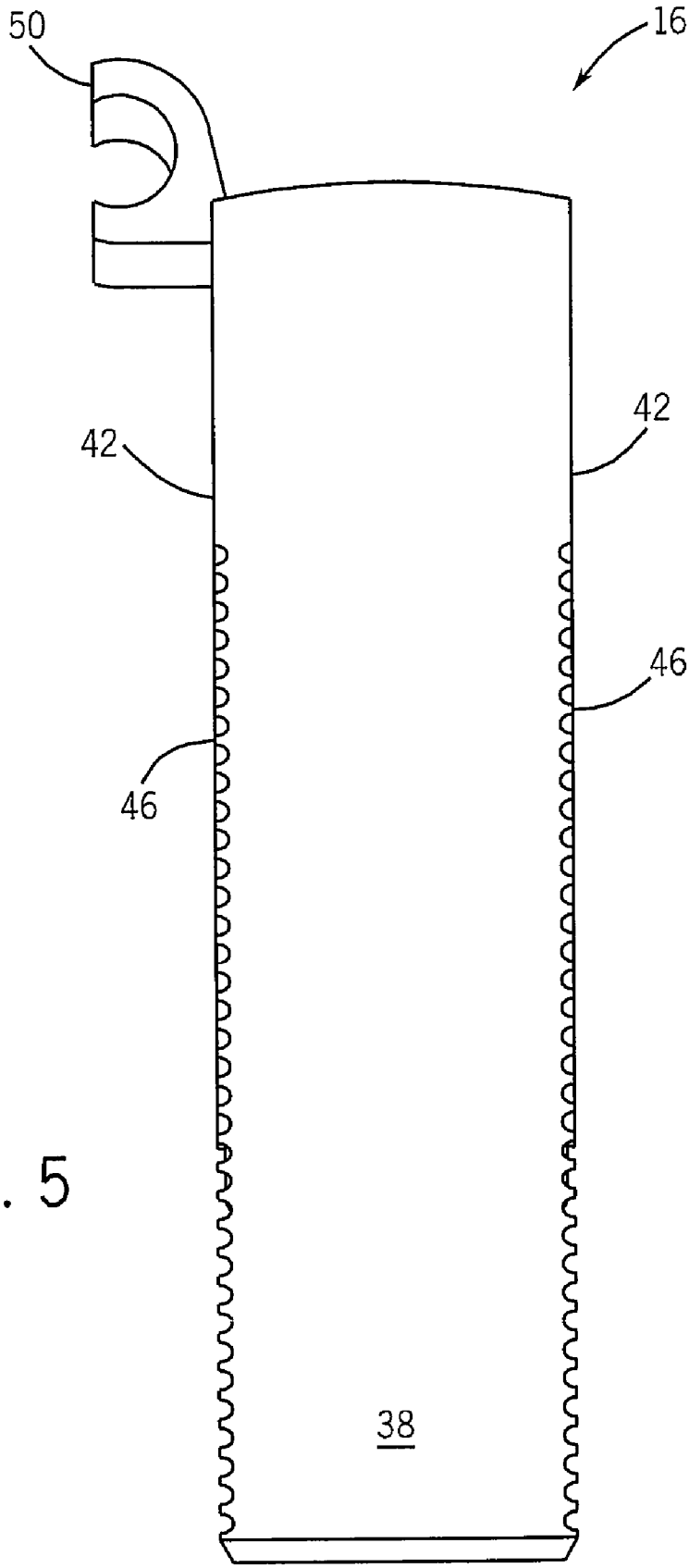
FIG. 5 is a front view showing a hook of the clip of FIG. 2.

Turning to FIGS. 3, 4, and 5, the hook 16 for supporting the base 18 and attaching the clip 10 to the toilet bowl 12 has three main segments. A bowl segment 28, a top rim segment 30, and an inner rim segment 32. All three segments 28, 30, 32 are preferably integrally molded from plastic (e.g., polyethylene or polypropylene) and form a flexible hook 16. The bowl segment 28 has a substantially rectangular cross-section and a flared elastomeric grip 34 with ribs 37 at a lower end for helping to secure the clip 10 to the toilet bowl 12. Suitable elastomeric materials include, without limitation, neoprene, polyurethane rubbers, and silicone rubbers. The bowl segment 28 extends substantially vertically upward and transitions into the top rim segment 30 at a flexible elbow 35 that allows the hook 16 to flex predominantly in the F-F direction (shown on FIG. 3) to secure the clip 10 to toilet bowls of various shapes and sizes. The top rim segment 30 has a substantially rectangular cross-section and extends horizontally across the rim 14 of the toilet bowl 12 where it transitions into the inner rim segment 32 at another flexible elbow 36, also allowing the hook 16 to flex. The inner rim segment 32 extends vertically downward from the elbow 36 and is configured to engage and support the base 18.

The inner rim segment 32 of the hook 16 has a front face 38 and a rear face 40 joined by two short side faces 42. A rib 44 protrudes from the rear face 40 of the inner rim segment 32 and extends the length thereof. As discussed in detail below, the rib 44 limits the angle of rotation of the base 18 with respect to the hook 16. The rib 44 of the example embodiment has a substantially rectangular cross-section, however, the rib 44 may have a curved cross-section, a square cross-section, comprise two spaced apart members, and the like. Additionally, the rib 44 need not extend the length of the inner rim segment 32 provided the rib 44 engages the base 18 throughout the desired adjustable range of the base 18. The short side faces 42 have ratchet teeth 46 used in conjunction with the base 18 to restrain vertical movement of the base 18 along a vertical axis 48. Other restraints may be used, such as a friction fit between the hook 16 and base 18, or the like.

The bowl segment 28 and the top rim segment 30 include a series of C-shaped channels 50 that restrain the conduit 24 as it is routed around the perimeter of the hook 16 on its way to the nozzle 20 in the base 18. The bowl segment 28 of the present embodiment includes three C-shaped channels 50 of alternating openings. The conduit 24 is pressed into the C-shaped channels 50, however, the channels 50 could be rectangular or any other suitable shape to restrain the conduit 24. The top rim segment 30 preferably includes one channel 50 helping to route the conduit 24, however, more may be used if needed.

Figure 6:
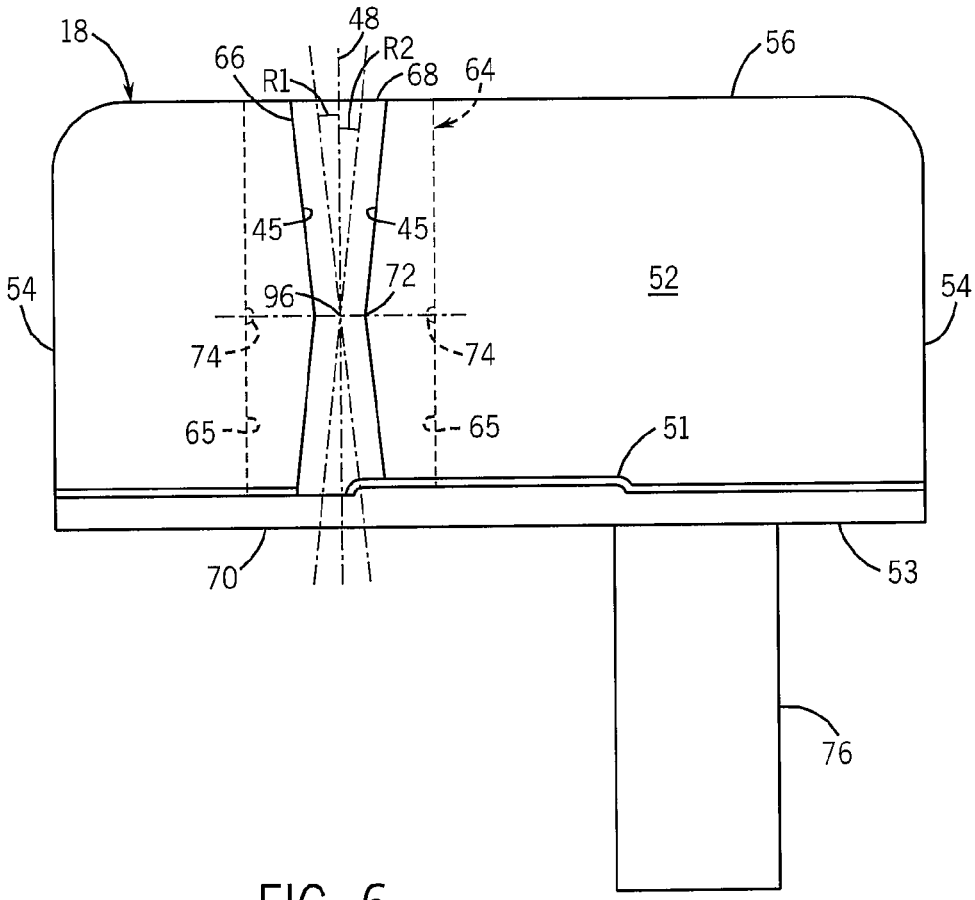
FIG. 6 is a rear view of a portion of the clip of FIG. 2.

Turning to FIGS. 3, 4, and 6 the base 18 has a back face 52, a pair of spaced apart side faces 54 extending forward of the back face 52, a top face 56 and a front face 58 extending between the side faces 54, and a curved face 60 extending between the side faces 54, top face 56, and front face 58. The faces 52, 54, 56, 58, 60 define a partial cavity 62 housing a portion of the nozzle 20. The base 18 has a tab 53 that extends rearward from the back face 52 of the base 18. The tab 53 helps orientate the base 18 with respect to the rim 14 when the clip 10 is mounted to the toilet bowl 12, as discussed below. The tab 53 may be one continuous member as shown in the example embodiment, or alternatively, the tab 53 may include a plurality of members extending from the base 18. The base 18 is preferably molded from plastic (e.g., polyethylene or polypropylene).

With emphasis on FIG. 6, the base 18 includes a channel 64 for receiving the inner rim segment 32 of the hook 16. The channel 64 includes a slit 66 for receiving the rib 44 having an entrance 68, an exit 70, and a middle 72. The width of the slit 66 decreases from the entrance 68 to the middle 72 and increases from the middle 72 to the exit 70. In one embodiment, the middle 72 is approximately half way between the entrance 68 and the exit 70; however, the narrowest point need not be halfway between the entrance 68 and exit 70, but may occur anywhere between the extremes of the slit 66. Additionally, the maximum width of the slit 66 may vary depending on the desired degree of adjustment of the base 18 with respect to the hook 16. If greater rotational adjustment of the base 18 is desired, the maximum width of the slit 66 at the entrance 68 and exit 70 may be increased; alternatively, or in addition, the width of the rib 44 may be decreased.

The channel 64 includes a pair of projections 74 extending from the walls of the short sides 65 of the channel 64 to engage the ratchet teeth 46 of the hook 16 as the inner rim segment 32 slides within the channel 64. The projections 74 are configured to engage the ratchet teeth 46 to inhibit vertical sliding of the base 18 with respect to the hook 16. The projections 74 may be rounded, terminate in a point, or other suitable geometry. Many other structures are capable of providing the desired restraint, such as a spring-loaded ball that is housed in a cavity formed in the channel 64 to urge the ball against a contour (e.g., ratchet teeth 46) of the channel 64. The engagement between the projections 74 and the ratchet teeth 46 is such that the base 18 is capable of the desired rotation (discussed below) without causing the projections 74 and ratchet teeth 46 to disengage.

The base 18 further includes a means to attach a nozzle 20. In the example embodiment, the nozzle 20 is restrained laterally between a fluid inlet 80 and a barrel 78. The base 18 includes an arm 76 extending downward from the base 18. The arm 76 is a flat bar with a J-shaped bend extending forward with a barrel 78 located at the distal end of the arm 76. The barrel 78 includes a recess for receiving the bottom of the nozzle 20. The base 18 also has a fluid inlet 80 located in the curved face 60 that tapers from the opening (shown in FIG. 3). The fluid inlet 80 and the barrel 78 are used in conjunction to restrain lateral movement of the nozzle 20, but allow the nozzle 20 to rotate about the nozzle axis 82. A sensor 98 for sensing the environment surrounding the clip 10 may be mounted to the base 18.

Figure 8:
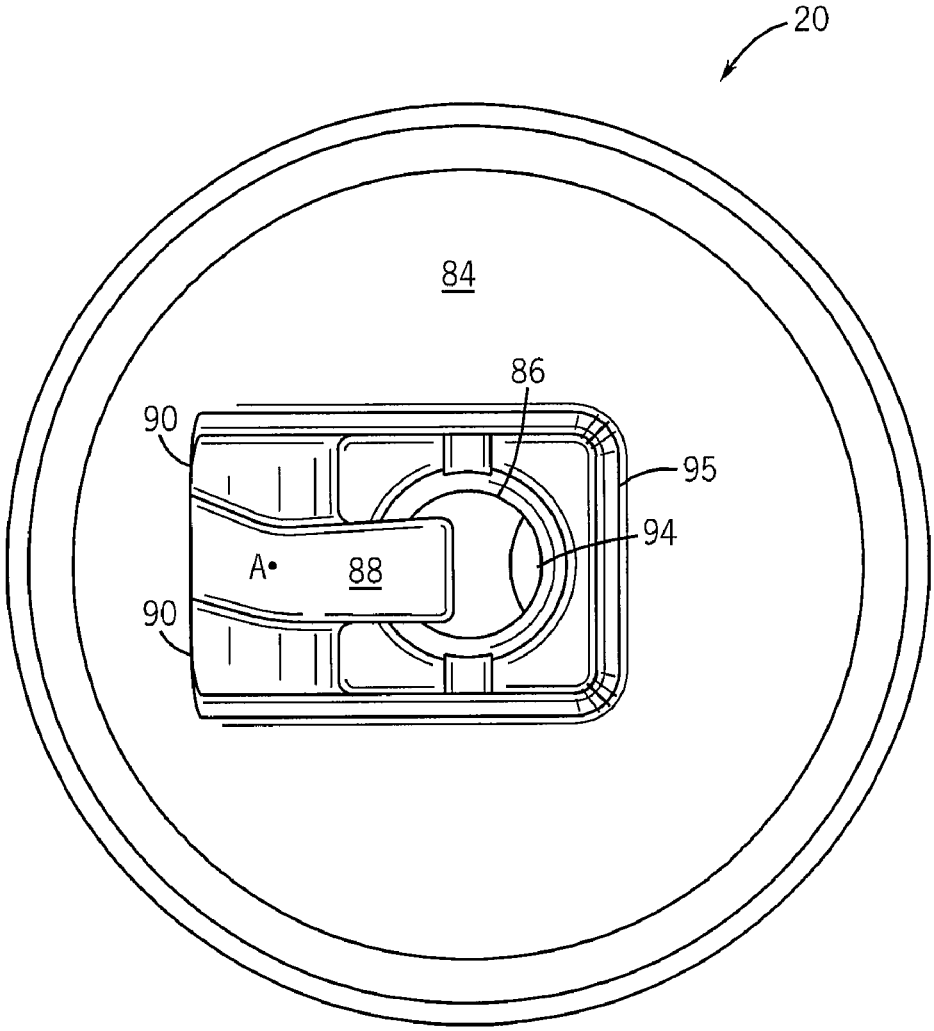
FIG. 8 is a top view of a portion of the sprayer of the clip taken along line 8-8 of FIG. 3.

Turning to FIG. 8, an embodiment of the nozzle 20 is described. The nozzle 20 is preferably molded from plastic (e.g., polyethylene and polypropylene). The nozzle 20 includes a circular deflection plate 84, a passageway 86 extending upwards from the deflection plate 84 and in fluid communication with the fluid inlet 80. A channel 88 extends radially outward from the passageway 86 near the deflection plate 84 and angles away from the initial channel 88 path at point A as shown in FIG. 8. The channel 88 is flanked by a pair of fins 90 that extend upwardly from the deflection plate 84. The contour of the channel 88 and fins 90 may vary depending on the desired rotational speed of the nozzle 20, pressure of the fluid, and the like.

As shown most clearly in FIGS. 3 and 8, the nozzle 20 is restrained laterally in the base 18 by inserting a spindle 92 extending from the underside of the deflection plate 84 into the recess in the barrel 78 of the arm 76 and by inserting the tapered end of the fluid inlet 80 into the passageway 86 where it abuts a ledge 94 formed in the passageway 86. The nozzle 20 is free to rotate about the nozzle axis 82, but is restrained from lateral movement.

The means for attaching the fluid sprayer may include a nozzle 20 suspended from the base 18 without the use of an arm 76. The nozzle 20, may be snap-fit to the base 18, screwed to the base 18, wedged to the base 18, and the like. Furthermore, an arcuate arm (not shown) may extend from the base 18 to support the nozzle 20.

In operation, fluid is moved from the container 22 through the conduit 24, which is routed through the channels 50 along the hook 16, and into the fluid inlet 80 on the base 18. Fluid flows into the top of the nozzle 20, down the passageway 86 where it is directed radially outward by the channel 88. As the fluid exits the channel 88 its path is altered by the angled fins 90 flanking the channel 88. The reaction causes the nozzle 20 to rotate counterclockwise as viewed in FIG. 8. As a result, the fluid is expelled radially outward from the nozzle 20 onto the inside surface 26 of the toilet bowl 12.

With the general structure and operation of the fluid sprayer described, we turn our attention to the means for rotating the base 18 and thus adjusting the area covered by the fluid dispensed from the nozzle 20. Returning to FIGS. 4 and 6, and with reference to FIG. 7, the base 18 can be rotated relative to the hook 16 about a horizontal axis 96 extending substantially normal from a plane defined by the vertical axis 48 and the back face 52 of the base 18. The slit 66 formed in the channel 64 is flared at the entrance 68 and exit 70. This allows the base 18 to rotate near the middle 72 about the horizontal axis 96 until the rib 44 protruding from the hook 16 abuts the slit sides 45 formed in the back face 52.

Figure 7:
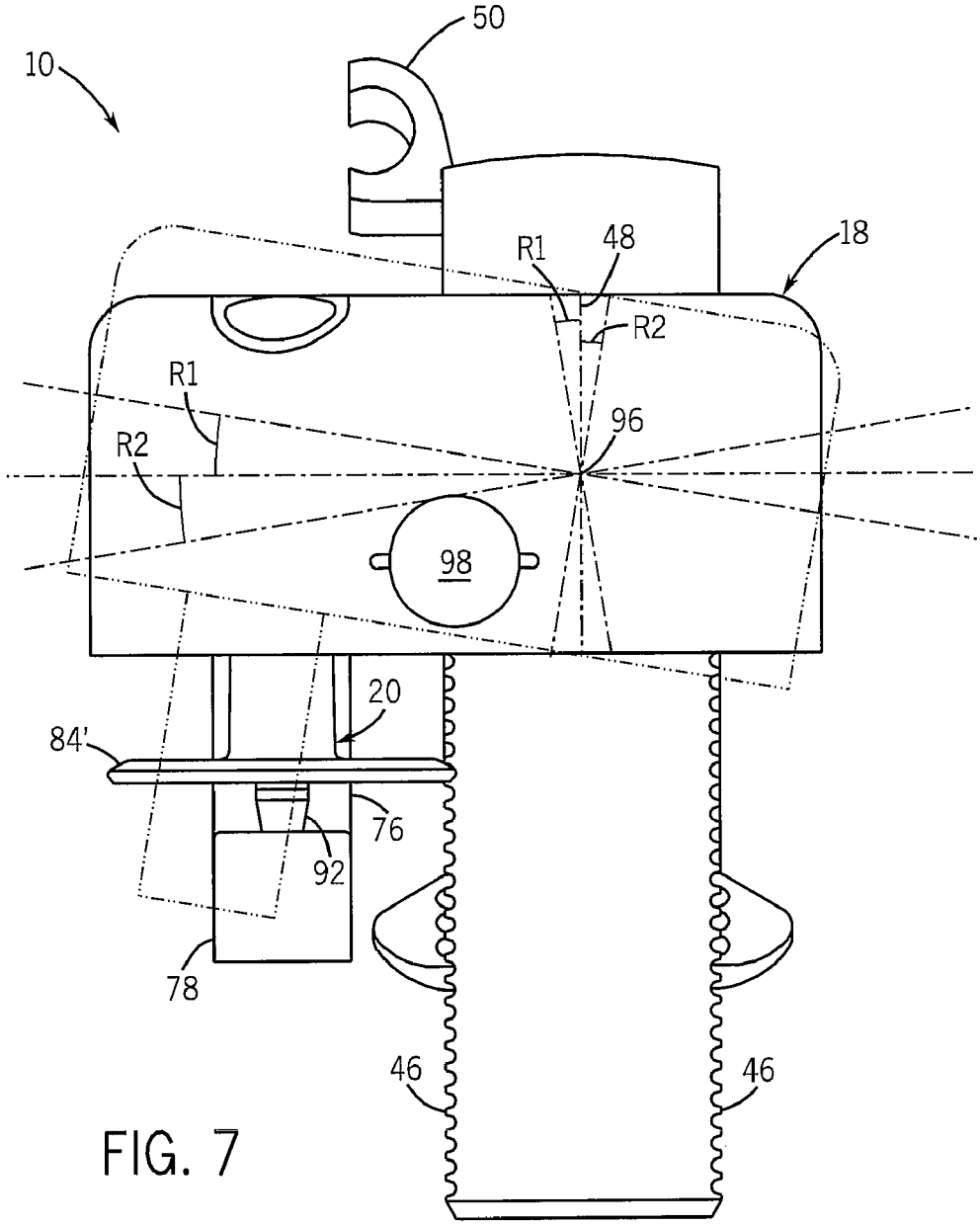
FIG. 7 is a front view of the clip of FIG. 2 showing the clip in rotated (dashed lines) and non-rotated (solid lines) orientations.

For example, with reference to FIG. 7, when the base 18 is rotated by an angle R1 with respect to the vertical axis 48 (shown by dashed lines) the relative placement of the nozzle 20 is angled accordingly, thus altering the area covered by the fluid dispensed from the nozzle 20. Additionally, when the base 18 is rotated by an angle R2 in the opposite direction, the coverage of the fluid dispensed by the nozzle 20 is again altered. As the base 18 rotates, the projections 74 slide within a respective tooth of the ratchet teeth 46; thus, the fit between the projections 74 and the ratchet teeth 46 should allow for the base 18 to rotate freely while also inhibiting vertical movement of the base 18. This rotational adjustment allows the clip 10 to accommodate toilets and enclosures of varying geometries.

The means for rotating the base 18 need not include a slit 66 as described. For example, the back face 52 may include several pairs of opposed fingers in the plane defined by the back face 52 for restraining the rotation of the rib 44 of the hook 16. The opening between a pair of opposed fingers near the entrance and the opening of a pair of opposed fingers near the exit are larger than the opening between a pair of opposed fingers located between the entrance and exit fingers. As a result, the base 18 is capable of rotating until the rib 44 engages the fingers near the entrance and exit. In another embodiment, the slit 66 may have a V-shape wherein the entrance tapers to the exit, or the opposite. Thus, the point of rotation of the base 18 is located near the exit of the slit 66, or smaller of the entrance and exit. Again, the rotation of the base 18 is limited by the rib 44 engaging the slit sides 45.

The rotational adjustment of the base 18 may be performed manually by a user of the clip 10 or automatically as the clip 10 is mounted to the enclosure, here a toilet bowl 12. With general reference to FIGS. 1-4, 6, and 7, the clip 10 is mounted substantially as follows. The clip 10 is secured to the rim 14 of the toilet bowl 12 by urging the hook 16 in the F-F direction away from the base 18 and placing the clip 10 over the rim 14. Once the hook 16 is secured, the base 18 is slid along the vertical axis 48 up the hook 16 and ratchet teeth 46 until the tab 53 engages the underside of the rim 14. As the tab 53 of the base 18 continues to engage the underside of the rim 14, the base 18 is rotated about the horizontal axis 96, thus aligning the nozzle 20 with the plane of the underside of the rim 14 and helping to ensure that the fluid from the nozzle 20 is dispensed onto the inside surface 26 of the toilet bowl 12 (assuming the plane of the underside of the rim 14 is parallel with the plane defined by the topside of the rim 14). The tab 53 may further include an elastomeric grip 51 protruding from the distal end of the tab 53 helping to secure the base 18 in its engaged position on the rim 14. The base 18 need not include a tab 53; in this embodiment, the base 18 may be manually rotated by the user to adjust the base 18 with respect to the hook 16.

Having described the clip 10 for securing the spray nozzle 20 adjacent the rim 14 of the toilet bowl 12, various manual pumps for supplying fluid from the container to the spray nozzle 20 can be described. Referring to FIGS. 9 and 10, there is shown a fluid dispensing pump 120 that may be used to pump fluid from a container 122 to the conduit 24 that supplies fluid to the spray nozzle 20 as described above. The fluid dispensing pump 120 can be mounted on the side of the toilet tank as in FIG. 1, or placed on the top of the toilet tank, or placed on the floor. The fluid dispensing pump 120 may be attached to the container 122 by way of a threaded closure 124 in a conventional manner.

The fluid dispensing pump 120 includes a dispenser head 126 that defines an actuator and has a discharge conduit 128. The dispenser head 126 is attached to a hollow tubular piston 130 having a ball valve 132 at its upper end. The piston 130 translates in a collar 134 that is secured in an aperture in the closure 124. The fluid dispensing pump 120 also includes an accumulator 136 that defines a pump chamber and is contained in a housing 138. An annular seal 140 at the bottom of the piston 130 seals against an inner surface 142 of the accumulator 136. A helical compression spring 144 is arranged between lower shoulders 146 of the piston 130 and lower shoulders 148 of the accumulator 136. The accumulator 136 includes a ball valve 150 at its lower end. The accumulator 136 also has a tubular inlet port 152 that receives a dip tube 154 for sucking fluid from the container 122. The accumulator 136 is oriented collinear with a vertical (longitudinal) axis of the container 122.

The dispenser head 126 is shown in FIG. 10 in its upper position. When the dispenser head 126 is pressed downward in direction D from its upper position by a hand (or a foot) and released, fluid from the container is suctioned into the accumulator 136 on the upstroke of the piston 130 (the upstroke being effectuated by the upward biasing force of the spring 144). After a number of downstrokes and upstrokes of the piston 130, sufficient fluid is present in the accumulator 136 such that subsequent downstrokes of the piston 130 force fluid upward past the ball valve 132 and out the discharge conduit 128. The discharge conduit 128 is in fluid communication with a conduit 156 that is in fluid communication with conduit 24 by way of a one way check valve assembly 158 that only allows fluid flow in direction W shown in FIG. 9. Fluid entering the conduit 24 is sprayed by nozzle 20 onto the inside surface 26 of the toilet bowl 12 as described above. The amount of fluid delivered by a downstroke of the fluid dispensing pump 120 can vary depending on the size of the pump components such as the piston 130 and the accumulator 136. In one example embodiment, the fluid dispensing pump 120 delivers 8 milliliters of fluid on a downstroke of the piston 130. Fluid pressures can be in the range of 10 to 20 psi (69 to 138 kilopascals).

Figure 11:
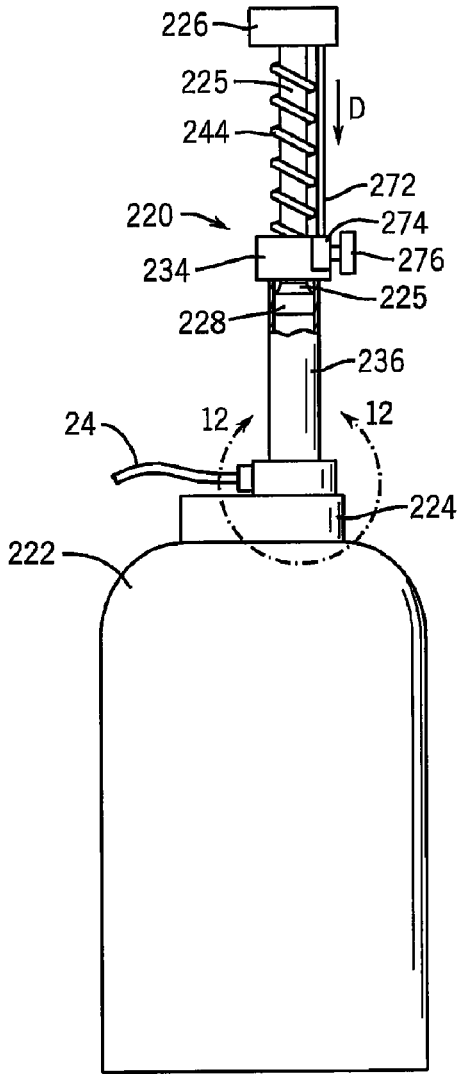
FIG. 11 is a front view of another fluid dispensing pump that may be used to pump fluid from a container to the sprayer of the invention.
Figure 12:
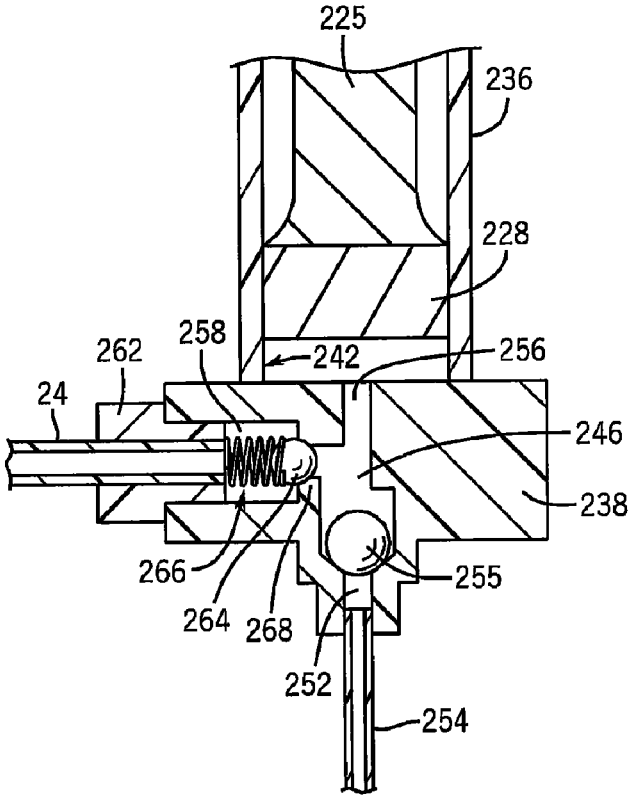
FIG. 12 is a detailed vertical cross-sectional view of the fluid delivery system of the fluid dispensing pump of FIG. 11 taken along line 12-12 of FIG. 11.

Referring to FIGS. 11 and 12, there is shown another fluid dispensing pump 220 that may be used to pump fluid from a container 222 to the conduit 24 that supplies fluid to the spray nozzle 20 as described above. The fluid dispensing pump 220 can be mounted on the side of the toilet tank as in FIG. 1, or placed on the top of the toilet tank, or placed on the floor. The fluid dispensing pump 220 may be attached to the container 222 by way of a threaded closure 224 in a conventional manner.

The fluid dispensing pump 220 includes a piston 225 having an upper end grip 226 that defines an actuator. The piston 225 also has a piston head 228. The piston 225 translates in a collar 234 that is mounted on a hollow cylinder 236 that defines a pump chamber and that is integral with a base 238 that is secured to the closure 224. The piston head 228 seals against an inner surface 242 of the cylinder 236. A helical compression spring 244 is arranged between a lower surface of the end grip 226 of the piston 225 and an upper surface of the collar 234. The cylinder 236 is oriented parallel with a vertical (longitudinal) axis of the container 222.

The base 238 has central manifold 246 in fluid communication with an inlet port 252 that receives a dip tube 254 for sucking fluid from the container 222. A ball valve 255 seats on the inlet port 252 for preventing fluid from reentering the container 222 on a downstroke of the piston 225. A fluid passageway 256 places the cylinder 236 and the manifold 246 in fluid communication. The base 238 also has a discharge conduit 258 in fluid communication with the central manifold 246. The conduit 24 may be placed in fluid communication with the discharge conduit 258 by way of a coupling 262. A ball valve 264 is biased against a valve seat 265 of the discharge conduit 258 by way of compression spring 266. The ball valve 264 allows fluid flow out of the discharge conduit 258 on a piston downstroke but prevents fluid from reentering the central manifold 246 on an upstroke of the piston 225.

The piston 225 is shown in FIG. 11 in its upper position. When the piston 225 is pressed downward in direction D by a hand (or foot) and released, fluid from the container 222 is suctioned into the cylinder 236 on the upstroke of the piston 225 (the upstroke being effectuated by the upward biasing force of the spring 244). Thus, the pump 220 is primed. A subsequent downstroke of the piston 225 forces fluid past the ball valve 264 and out the discharge conduit 24. Fluid entering the conduit 24 is sprayed by nozzle 20 onto the inside surface 26 of the toilet bowl 12 as described above.

The amount of fluid delivered by a downstroke of the piston 225 can be varied by adjusting distance between the end grip 226 of the piston 225 and the collar 234. The means for varying the downstroke of the piston 225 comprises a shaft 272, a collar 274 and a set screw 276. The shaft 272 is attached to an underside of the end grip 226 of the piston 225, and the shaft 272 translates an opening in the collar 274. The set screw 276 is inserted in a threaded side opening in the collar 274 and can immobilize the shaft 272 in the collar 274 by way of contact of the set screw 276 with the shaft 272. By moving the shaft 272 downward in the collar 274 and immobilizing the shaft 272 with the set screw 276, the distance between the end grip 226 of the piston 225 and the collar 234 is decreased and therefore, lower volumes of fluid are sucked into the cylinder 236 on the upstroke of the piston 225. In one example embodiment, the fluid dispensing pump 220 can deliver up to 10 milliliters of fluid on a downstroke of the piston 225, with a delivery of 5 to 10 milliliters being preferred, and a delivery of 7 to 8 milliliters being most preferred.

Figure 13:
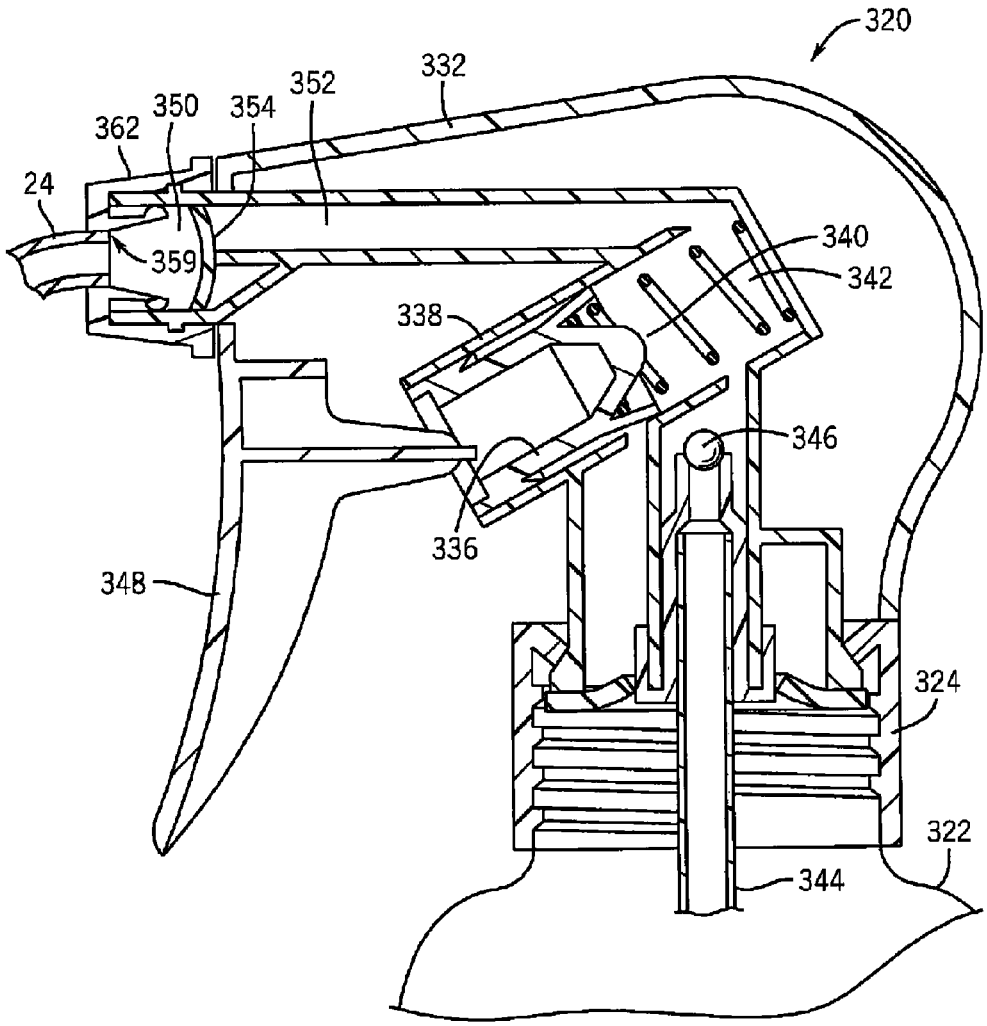
FIG. 13 is a vertical cross-sectional view of yet another fluid dispensing pump that may be used to pump fluid from a container to the sprayer of the invention.

Referring to FIG. 13, there is shown yet another fluid dispensing pump 320 that may be used to pump fluid from a container 322 to the conduit 24 that supplies fluid to the spray nozzle 20 as described above. The fluid dispensing pump 320 can be mounted on the side of the toilet tank as in FIG. 1, or placed on the top of the toilet tank, or placed on the floor. The fluid dispensing pump 320 may be attached to the container 322 by way of a threaded closure 324 in a conventional manner. The dispenser 320 has a body 332 and a sprayer mechanism held by or formed within the body 332. The sprayer mechanism includes a piston 336 and cylinder 338 having cylinder head space 340 above the face of the piston 336. A pump chamber 342 is defined by the cylinder 338 that is in fluid communication with the cylinder head space 340. The dispenser 320 also includes a dip tube 344 for transferring fluid to the chamber 342 from the container 322. The fluid transfer means includes a ball check valve 346 which allows fluid being transferred via the fluid transfer means to flow only toward and not away from the chamber 342.

The dispenser 320 also includes a finger operated trigger 348 that defines an actuator and reciprocatingly moves the piston 336 within the cylinder 338, alternatingly increasing and decreasing the cylinder head space 340 to draw liquid into the pump chamber 342 and then expel liquid from the chamber 342. The dispenser 320 also includes a discharge manifold 350, together with a discharge conduit 352 that provides fluid communication between the chamber 342 and the discharge manifold 350. The discharge conduit 352 has a discharge check valve 354 that permits fluid to move toward the discharge manifold 350 and not back toward the chamber 342. Fluid flows from the discharge manifold 350 into the conduit 24 which is secured by press fit in an aperture 359 in a nozzle cap 362. Fluid entering the conduit 24 is sprayed by nozzle 20 onto the inside surface 26 of the toilet bowl 12 as described above.

Thus, the present invention provides a toilet bowl cleaning device that sprays a chemical laterally around a perimeter of a nozzle of the device. As a result, full coverage of the chemical around the inner surface of the toilet bowl is possible.

Various cleaning and/or deodorizing chemicals are suitable for use with a toilet bowl cleaning device according to the invention. For example, mildly acidic and near neutral pH antimicrobial compositions such as those described in U.S. Pat. Nos. 6,471,974 and 6,162,371 can be advantageous when used with a toilet bowl cleaning device according to the invention. Alkaline antimicrobial toilet bowl cleaning formulations such as those described in U.S. Pat. No. 6,425,406 can also be advantageous. Acidic compositions such as those described in U.S. Pat. No. 6,812,196 may also be suitable. When using a steel container and acidic compositions, a steel container with a plastic liner or a bladder with a surrounding propellant may be desirable to minimize acidic corrosion of the steel container. Aluminum containers may also be an option for acidic compositions. The amount of chemical applied to the toilet bowl and/or toilet water depends on the composition chosen. For example, in an acidic composition including lactic acid, surfactant, and solvent, a 2 to 10 milliliter dose of chemical may be appropriate. The above chemicals are non-limiting illustrative examples of cleaning and/or deodorizing chemicals suitable for use with a toilet bowl cleaning device according to the invention. Other example suitable chemicals include, for example, enzymes, chelating agents, corrosives and amino acids.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides a toilet bowl cleaning device for spraying an inner surface of the toilet bowl, and/or the toilet water, and/or under the toilet rim with a cleaning and/or deodorizing chemical.

What is claimed is:

1. A device for spraying an inner surface of a wall of an enclosure with a fluid, the device comprising:

a container for the fluid;

a fluid sprayer through which the fluid can be sprayed laterally at least halfway around a perimeter of the fluid sprayer;

means for attaching the fluid sprayer near the inner surface of the wall of the enclosure;

a fluid conduit in fluid communication with the container and the fluid sprayer; and a manually operated pump for delivering fluid from the container through the fluid conduit and to the fluid sprayer when the pump is operated, and wherein the fluid sprayer comprises a rotating nozzle, and the nozzle comprises a deflection plate, a fluid inlet at an upper end of the nozzle, a passageway extending between the fluid inlet and the deflection plate, a channel in fluid communication with a lower end of the passageway, and a pair of fins flanking the channel and extending upwardly from the deflection plate, the fins being contacted by the fluid to rotate the nozzle.

2. The device of claim 1 wherein the pump comprises:

a pump chamber in fluid communication with the container;

a discharge conduit in fluid communication with the pump chamber and in fluid communication with the fluid conduit; and a piston that reciprocates in the pump chamber for drawing fluid from the container into the pump chamber and moving fluid from the pump chamber through the discharge conduit and into the fluid conduit.

3. The device of claim 2 wherein the pump further comprises:

an actuator in contact with the piston for manually reciprocating the piston in the pump chamber.

4. The device of claim 3 wherein:

the actuator comprises a pivoting trigger.

5. The device of claim 3 wherein:

the actuator comprises a horizontal member approximately transverse to the piston.

6. The device of claim 2 wherein the pump further comprises:

means for adjusting an amount of the fluid moving from the pump chamber through the discharge conduit and into the fluid conduit on a stroke of the piston in the pump chamber.

7. The device of claim 2 wherein the pump further comprises:

a check valve between the fluid conduit and the discharge conduit.

8. The device of claim 2 wherein:

the pump chamber is oriented collinear or parallel with a vertical axis of the container.

9. The device of claim 2 wherein:

the pump delivers about 5 to about 10 milliliters of fluid to the fluid sprayer on a stroke of the piston in the pump chamber.

10. The device of claim 2 wherein:

the pump can deliver about 50 or more milliliters of fluid to the fluid sprayer on a stroke of the piston in the pump chamber.

11. The device of claim 1 wherein:

the fluid sprayer is structured such that the fluid can be sprayed laterally around the entire perimeter of the fluid sprayer.

12. The device of claim 1 wherein the deflection plate is circular.

13. The device of claim 1 wherein the means for attaching the fluid sprayer near the inner surface of the wall of the enclosure comprises:

a base;

a hook configured to support the base adjacent the wall of the enclosure; and means for attaching the fluid sprayer to the base.

14. The device of claim 13 wherein the means for attaching the fluid sprayer to the base comprises:

an arm extending from the base.

15. The device of claim 1 wherein the enclosure is one of a tub or a shower or a toilet.

16. A device for spraying an inner surface of a toilet bowl with a chemical, the device comprising:

a container for the chemical;

a sprayer through which the chemical can be sprayed laterally at least halfway around a perimeter of the sprayer;

means for attaching the sprayer near a rim of the toilet bowl;

a fluid conduit in fluid communication with the container and the sprayer; and a manually operated pump for delivering chemical from the container through the fluid conduit and to the sprayer when the pump is operated, and wherein the sprayer comprises a nozzle including a fluid inlet and a deflection plate, the fluid inlet being in fluid communication with the fluid conduit and the deflection plate, the deflection plate rotating when contacted by chemical from the fluid inlet.

17. The device of claim 16 wherein the pump comprises:

a pump chamber in fluid communication with the container;

a discharge conduit in fluid communication with the pump chamber and in fluid communication with the fluid conduit; and a piston that reciprocates in the pump chamber for drawing chemical from the container into the pump chamber and moving chemical from the pump chamber through the discharge conduit and into the fluid conduit.

18. The device of claim 17 wherein the pump further comprises:

an actuator in contact with the piston for manually reciprocating the piston in the pump chamber.

19. The device of claim 17 wherein the pump further comprises:

means for adjusting an amount of the chemical moving from the pump chamber through the discharge conduit and into the fluid conduit on a stroke of the piston in the pump chamber.

20. The device of claim 16 wherein:

the sprayer is structured such that the chemical can be sprayed laterally around the entire perimeter of the sprayer.

21. The device of claim 16 wherein the means for attaching the sprayer near the rim of the toilet bowl comprises:

a base;

a hook configured to support the base adjacent the rim of the toilet bowl; and means for attaching the sprayer to the base.

22. The device of claim 16 wherein:

the deflection plate is circular.

23. The device of claim 16 wherein the pump is selected from vein pumps, bellows pumps, impeller driven pumps, piston pumps, peristaltic pumps and gear driven pumps.

* * * * *